US010494125B2

(12) United States Patent
Andersson

(10) Patent No.: US 10,494,125 B2
(45) Date of Patent: Dec. 3, 2019

(54) DEVICE AND METHOD IN A FILLING MACHINE

(71) Applicant: Tetra Laval Holdings & Finance S.A., Pully (CH)

(72) Inventor: Jan Andersson, Ystad (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 790 days.

(21) Appl. No.: 14/895,780

(22) PCT Filed: May 16, 2014

(86) PCT No.: PCT/EP2014/060044
§ 371 (c)(1),
(2) Date: Dec. 3, 2015

(87) PCT Pub. No.: WO2014/195112
PCT Pub. Date: Dec. 11, 2014

(65) Prior Publication Data

US 2016/0122051 A1 May 5, 2016

(30) Foreign Application Priority Data

Jun. 4, 2013 (SE) ..... 1350680

(51) Int. Cl.
*B65B 31/04* (2006.01)

(52) U.S. Cl.
CPC ..... *B65B 31/045* (2013.01)

(58) Field of Classification Search
CPC ..... B65B 31/045; B65B 31/044; B65B 31/06; B65B 31/08; B65B 31/01; B65B 57/10;
(Continued)

(56) References Cited

U.S. PATENT DOCUMENTS 2,160,367 A * 5/1939 Maxfield ..... B65B 9/213
206/524.8
2,618,814 A * 11/1952 Paton ..... B65B 9/24
156/144

(Continued)

OTHER PUBLICATIONS

International Search Report (PCT/ISA/210) dated Dec. 21, 2014, by the European Patent Office as the International Searching Authority for International Application No. PCT/EP2014/060044.

*Primary Examiner* — Nathaniel C Chukwurah
*Assistant Examiner* — Lucas E. A. Palmer
(74) *Attorney, Agent, or Firm* — Buchanan Ingersoll & Rooney PC

(57) ABSTRACT

The present invention relates to a device in a filling machine, said filling machine comprising a filling pipe for supplying liquid food to the tube of packaging material, a pipe for supplying pressurized sterile air to the tube of packaging material, and a gasket for sealing against the tube of packaging material and any pipes inside the tube, for creating an overpressure in the tube. The device further comprises a first pressure gauge for measuring a first pressure inside the pipe at a location upstream from the tube, a device for determining an air mass flow in the pipe, and a control unit for receiving the measured parameters, where the control unit is adapted to calculate the pressure in the tube based on the air mass flow and the first pressure, according to a first pre-established relationship. The invention also relates to a method being implemented by the device.

6 Claims, 2 Drawing Sheets

(58) Field of Classification Search
CPC ..... B65B 57/14; B65B 9/20–22; B67C 3/06; B67C 3/12
USPC ..... 53/551, 433, 434, 511, 512, 451
See application file for complete search history.

(56) References Cited

U.S. PATENT DOCUMENTS 2,687,740 A * 8/1954 Jarund ..... B65B 3/26 137/110
3,269,079 A * 8/1966 Schmied ..... B65B 55/06 53/127
3,457,968 A * 7/1969 Tuma ..... B65B 3/26 141/1
3,470,672 A * 10/1969 Tuma ..... B65B 3/26 137/209
3,520,321 A * 7/1970 Mojonnier ..... B67C 3/12 137/115.18
3,545,983 A * 12/1970 Woods ..... B65B 31/022 426/395
3,664,086 A * 5/1972 James ..... B65B 9/20 141/4
3,665,959 A * 5/1972 Castillon ..... F17D 1/04 137/505.22
3,789,888 A * 2/1974 James ..... B65B 9/213 141/4
3,970,426 A * 7/1976 Stark ..... A61L 2/202 422/24
4,099,914 A * 7/1978 Gustafsson ..... B65B 55/103 422/29
4,127,976 A * 12/1978 Jablonski ..... B65B 3/12 53/450
4,235,265 A * 11/1980 Feliks ..... B65B 55/02 141/264
4,241,563 A * 12/1980 Muller ..... B65B 39/04 53/511
4,308,710 A * 1/1982 Sandberg ..... B65B 39/04 53/433
4,539,903 A * 9/1985 Sugisawa ..... B65B 37/00 99/470
4,606,174 A * 8/1986 Berg ..... B65B 3/04 426/410
4,617,779 A * 10/1986 Nygren ..... B65B 9/20 426/410
4,636,391 A * 1/1987 Pike ..... B65B 55/02 426/106
4,731,980 A * 3/1988 Worden ..... B29C 53/48 493/302
4,738,287 A * 4/1988 Klinkel ..... B65B 37/14 141/114
4,784,697 A * 11/1988 Bordini ..... B65B 55/02 134/22.15
4,821,580 A * 4/1989 Jorritsma ..... G01F 1/34 702/47
4,860,804 A * 8/1989 Yamaguchi ..... B67C 3/12 141/192
4,874,021 A * 10/1989 Ringdahl ..... B65B 55/02 134/95.1
4,887,411 A * 12/1989 Rondeau ..... B65B 9/213 141/95
4,958,665 A * 9/1990 Iwano ..... B65B 3/30 141/114
4,972,180 A * 11/1990 Akai ..... A61L 2/24 340/611
5,016,684 A * 5/1991 Clusserath ..... B67C 3/06 141/39
5,142,846 A * 9/1992 Alameda ..... B65B 57/06 141/140
5,361,560 A * 11/1994 Sandolo ..... A23F 5/465 141/11
5,454,208 A * 10/1995 Kawano ..... A61J 1/10 53/133.2
5,473,867 A * 12/1995 Suga ..... B65B 31/04 53/511
5,546,733 A * 8/1996 Paltrinieri ..... B65B 9/12 141/95
5,558,135 A * 9/1996 Kronseder ..... B67C 3/10 141/39
5,582,217 A * 12/1996 Nish ..... B67C 3/10 141/1
5,720,326 A * 2/1998 Kaneko ..... B65B 3/14 141/114
5,813,197 A * 9/1998 Aguzzoli ..... B29C 49/0047 53/433
5,858,040 A * 1/1999 Hansen ..... B65B 55/027 55/385.2
6,018,932 A * 2/2000 Eberhardt, Jr. ..... B65B 25/067 53/432
6,035,614 A * 3/2000 Gustafsson ..... B65B 31/045 53/551
6,116,001 A * 9/2000 Kammler ..... B65B 37/14 141/67
6,220,000 B1 * 4/2001 Kammler ..... B65B 1/16 53/508
6,450,215 B1 * 9/2002 Willemstyn ..... B65B 3/003 141/10
6,568,157 B1 * 5/2003 Futase ..... B65B 3/10 141/105
6,619,018 B1 * 9/2003 Sasaki ..... B65B 31/045 53/511
6,645,429 B1 * 11/2003 Raniwala ..... B65B 55/027 422/260
6,729,108 B2 * 5/2004 Tsuruta ..... B29C 65/02 53/451
6,904,737 B2 * 6/2005 Engesser ..... B65B 1/12 53/238
7,069,964 B1 * 7/2006 Kakuda ..... B65B 3/28 141/165
7,958,697 B2 * 6/2011 Rapparini ..... B65B 9/06 53/425
2001/0005974 A1 * 7/2001 Kondo ..... B65B 9/20 53/508
2005/0076612 A1 * 4/2005 Andersson ..... B65B 55/103 53/167
2005/0126117 A1 * 6/2005 Benedetti ..... B65B 55/103 53/167
2006/0162290 A1 * 7/2006 Kakita ..... B65B 31/045 53/434
2006/0213153 A1 * 9/2006 Sanfilippo ..... B65B 31/045 53/511
2008/0000204 A1 * 1/2008 Turvey ..... B65B 31/024 53/512
2008/0110562 A1 * 5/2008 Mayer ..... B65B 9/06 156/281
2010/0126624 A1 * 5/2010 Conforti ..... B67C 3/06 141/147
2011/0099955 A1 * 5/2011 Konno ..... B29C 65/7451 53/545
2011/0154779 A1 * 6/2011 Baba ..... B29C 65/02 53/111 R
2011/0185686 A1 * 8/2011 Konno ..... B29C 65/7451 53/548
2012/0138631 A1 * 6/2012 Lurcott ..... B01F 3/0861 222/1
2012/0210681 A1 * 8/2012 Hennissen ..... B65B 9/213 53/559
2012/0266571 A1 * 10/2012 Persson ..... B65B 9/20 53/473
2012/0269459 A1 * 10/2012 Howes ..... B65B 9/04 383/37
2015/0284233 A1 * 10/2015 Meinzinger ..... B67C 3/10 141/6
2017/0144784 A1 * 5/2017 Illi ..... B65B 3/36

* cited by examiner

DEVICE AND METHOD IN A FILLING MACHINE

FIELD OF THE INVENTION

The present invention relates to a device and a method for monitoring and controlling the pressure at a downstream part of a pipe, and in particular for controlling the pressure at a downstream part of a pipe in a filling machine.

BACKGROUND OF THE INVENTION

In filling machines for liquid food packages, such as sold by Tetra Pak® under the name Tetra Pak A1, a web of packaging material is sterilized, and is subsequently formed into a tube. This tube is filled with liquid food continually, and the tube of packaging material is transversally sealed and cut such that separate packages with liquid food are formed. The liquid food is generally filled inside the tube of packaging material up to a certain height, such that a certain pressure is created during the forming and sealing of the packages. Normally, the pillar of liquid food is enough for having good package forming, but in certain instances an additional over-pressure is required. This is normally provided by connecting a tube system of pressurised sterile air to the filling pipe, providing an over-pressure inside the tube of packaging material, acting on the pillar of liquid food and being maintained by a tube seal, arranged inside the tube of packaging material and sealing against the internal pipes. However, the pressure above the liquid pillar is difficult to measure, and may fluctuate during production, for various reasons.

It is hence an object of the present invention to mitigate this drawback. In a first aspect, the invention provides a system for accurately monitoring the pressure inside the tube of packaging material by utilizing a method according to claim 1.

All features described in connection with any aspect of the invention can be used with any other aspect of the invention.

BRIEF DESCRIPTION OF THE DRAWINGS

The invention will be further described with reference to a preferred embodiment, as shown in the drawings in which.

DETAILED DESCRIPTION

Figure 1:
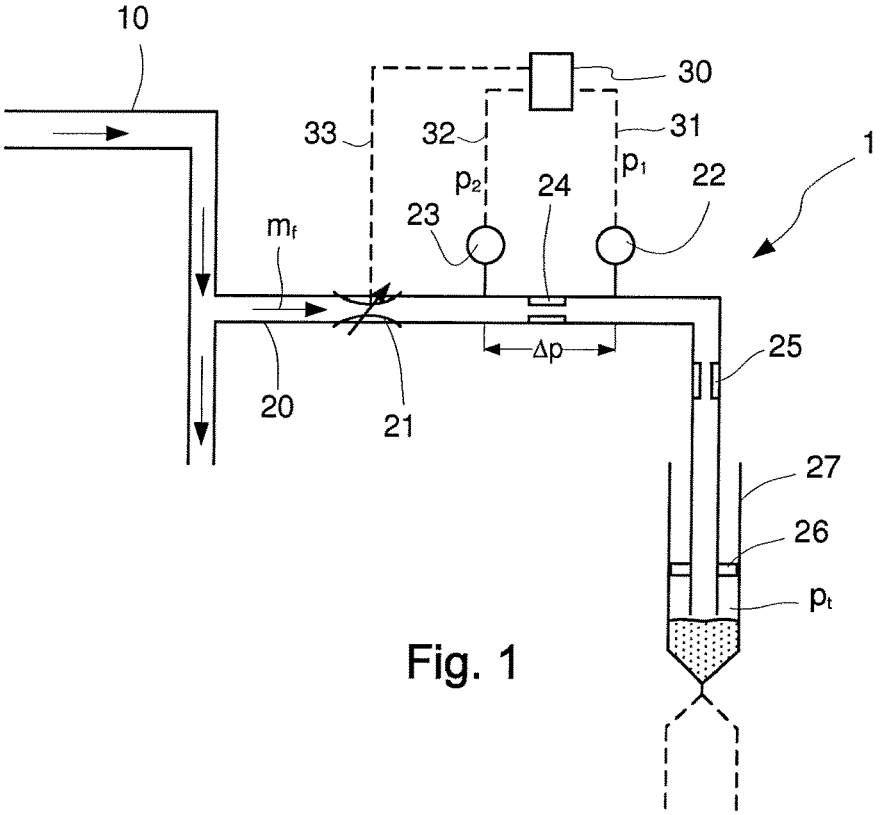
FIG. 1 shows a schematic drawing of the system according to one embodiment of the invention.

The present invention will now be described with references to the drawings. In FIG. 1, a schematic representation of the device 1 is shown for carrying out the method according to the invention. The device 1 comprises an inlet pipe 10, supplying the device with sterile, pressurized air from an undisclosed source, such as a tank or pump. A branch pipe 20 branches off from the main pipe, and is provided with a control valve 21. The branch pipe 20 is further provided with a first pressure gauge 22 and a second pressure gauge 23, being separated by a short distance along the branch pipe 20. The branch pipe 20 is then directed inside a tube 27 of packaging material. The branch pipe 20 is arranged either inside or outside the filling pipe (not shown) for the liquid food product. A tube seal 26 is provided outside the second pipe 20, for sealing against the supply pipes, i.e. second pipe 20 and filling pipe, and against the inside of the tube 27 of packaging material, which is already provided with a longitudinal sealing further upstream. The tube 27 of packaging material is sealed longitudinally and transversally by devices normally present in filling machines for liquid food packages, but those devices are not a part of the invention.

A precision-made restriction 24 is inserted between the first 22 and second 23 pressure gauges, having a diameter of 10 mm. The flow restriction from the first pressure gauge 22 to the tube 27 of packaging material is represented by a second restriction 25. The actual restriction is caused by the pipe itself, and its corners etc.

A control unit 30 is connected to the first pressure gauge 22 via a first connection 31 and to the second pressure gauge 23 via a second connection 32. The first 31 and second 32 connections send the pressure measurements to the control unit 30, for calculations. The control unit is connected to the control valve 21 via a control line 33.

Figure 2:
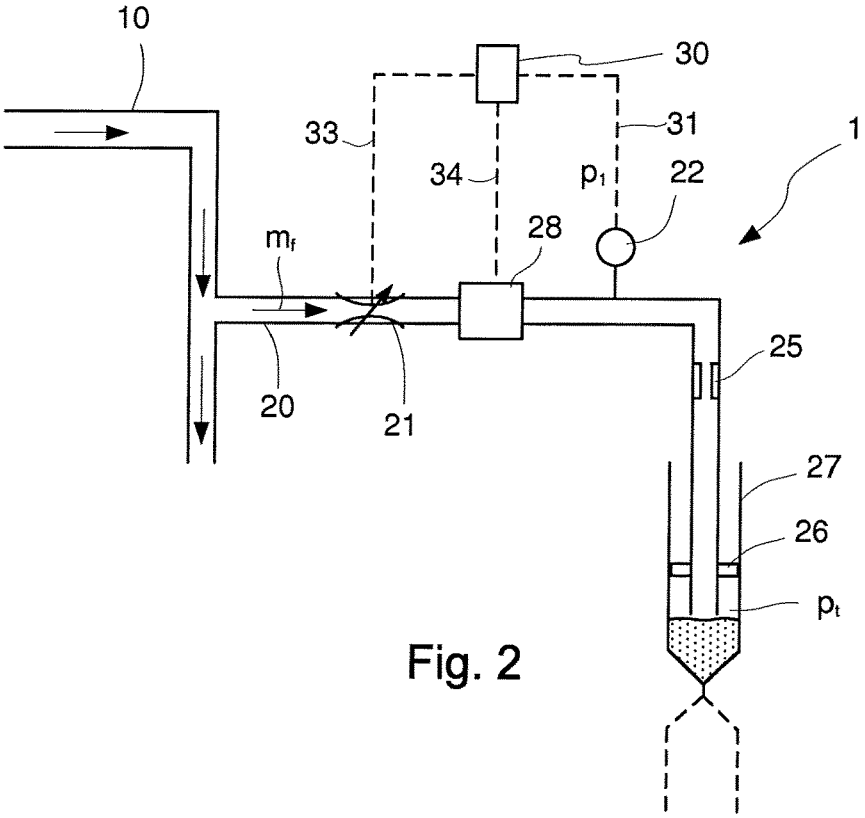
FIG. 2 shows a schematic drawing of an alternative embodiment of the invention.

In FIG. 2, an alternative embodiment is shown. Instead of the second pressure gauge 23, a mass flow meter 28 of a known type is inserted. This mass flow meter 28 may be a coriolis flow meter, a thermal mass flow meter, a pitot tube or similar. In this embodiment, the air mass flow meter 28 sends a signal relating to the air mass flow to the control unit 30 via a third connection 34.

The function of the device 1 will now be explained. The pressurized air from the inlet pipe 10 is directed through the second pipe 20 and through a control valve 21. The air mass flow through the second pipe 20 is denoted with $m_f$, and it is constant throughout the pipe. The air flow through the second pipe 20 enters the tube of packaging material, and the air leaks through the tube seal 26.

The pressure inside the second pipe 20 is measured by the pressure gauges 22, 23. However, the pressure to be monitored is the pressure $p_t$ inside the packaging material tube 27, but it is difficult, if not impossible, to have a pressure gauge inside the tube 27 of packaging material, e.g. for hygienic reasons. Instead, the pressure is measured at an upstream location by a first pressure gauge 22 and the pressure inside the tube 27 is the pressure at the first pressure gauge 22 minus the pressure drop occurring in the pipe due to the flow resistance of the air mass flow inside the pipe 20, from the location of the first pressure gauge 22. The flow resistance varies with the air flow, so this has to be established with calibrations in advance. The control unit 30 receives the measurements for the pressures (for the second embodiment the direct air mass flow), and calculates the pressure inside the tube 27 of packaging material. For moderate air flows, when the compressibility of the air is small, the following applies:

$$\begin{cases} p_t = p_2 - (p_2 - p_t) \\ (p_2 - p_t) = k_t \cdot m_f^2 \end{cases} \Rightarrow p_t = p_2 - k_t \cdot m_f^2$$

$$(p_1 - p_2) = k_R \cdot m_f^2 \ (R3) \Rightarrow p_t = p_2 - \frac{k_t}{k_R} \cdot (p_1 - p_2) \ (R2)$$

Figure 3:
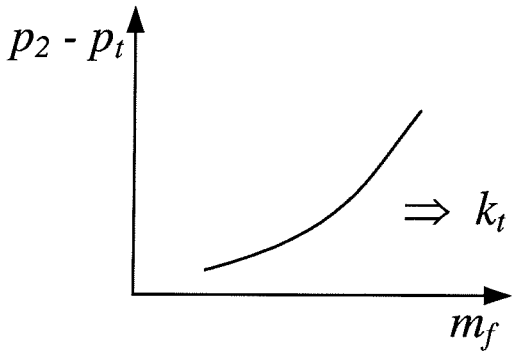
FIGS. 3-4 show graphs used for calculating constants used in the method of the invention.
Figure 4:
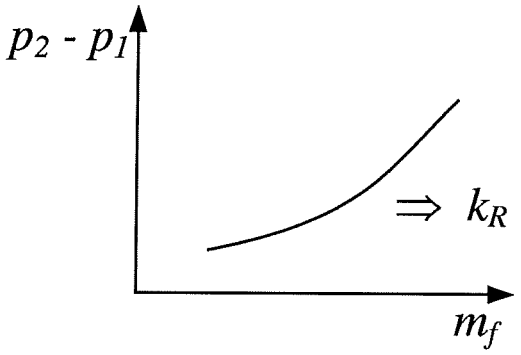

The constants $k_t$ and $k_R$ are given by measurements performed in advance, see FIGS. 3 and 4, where the measured pressure difference $\Delta p$ is plotted for different air mass flows $m_f$. The constant $k_t$ is used to determine the pressure drop from the first pressure gauge 22 to the tube 27 of packaging material. During operation of the filling machine, the pressures $p_1$ and $p_2$ are measured, and the difference $\Delta p$ is constantly monitored. The pressure $p_t$ inside the tube is then calculated, according to the above calculations, by the control unit 30. If the pressure $p_t$ deviates from pre-determined limits, the air mass flow is controlled, either increased or decreased, such that the correct pressure $p_t$ is achieved inside the tube. Should the air mass flow need to be increased or decreased too much, the machine might need to be stopped, for a more detailed control. This can e.g. happen when the tube seal 26 is worn out, and needs to be replaced. In the embodiment where there is only the first pressure gauge 22, and the air flow is measured directly with the mass flow meter 28, the pressure $P_t$ at the tube 27 of packaging material is calculated according to $$p_t = p_1 - k_t \cdot m_f^2 \quad \text{(R1)}$$

where the constant $k_t$ as before needs to be established through measurements performed in advance.

Whilst the invention has been described with reference to a preferred embodiment, it will be appreciated that various modifications are possible within the scope of the invention.

In this specification, unless expressly otherwise indicated, the word 'or' is used in the sense of an operator that returns a true value when either or both of the stated conditions is met, as opposed to the operator 'exclusive or' which requires that only one of the conditions is met. The word 'comprising' is used in the sense of 'including' rather than in to mean 'consisting of'. All prior teachings acknowledged above are hereby incorporated by reference. No acknowledgement of any prior published document herein should be taken to be an admission or representation that the teaching thereof was common general knowledge in Australia or elsewhere at the date hereof.

The invention claimed is:

1. Device in a filling machine for supplying liquid food to a tube of packaging material, said filling machine comprising a pipe for supplying pressurized sterile air to the tube of packaging material, and a gasket for sealing against the tube of packaging material and any pipes inside the tube, for creating an overpressure in said tube, the device comprising:

a first pressure gauge for measuring a first pressure inside the pipe at a location upstream from the tube, means for determining an air mass flow in said pipe, and a control unit for receiving the measured parameters, said control unit being adapted to calculate the pressure in said tube based on the air mass flow and the first pressure, according to a first pre-established relationship;

wherein the means for determining an air mass flow further comprises a second pressure gauge for measuring a second pressure, and a restriction located between the first pressure gauge and the second pressure gauge for obtaining measurements of a pressure difference between said first and second pressure gauges.

2. Device according to claim 1, where the pressure at the tube of packaging material is calculated by the control unit based on the pressure difference between the second pressure and the first pressure, and on the first pressure, according to a second pre-established relationship.

3. Device according to claim 1, wherein a control valve, being controlled by the control unit, is arranged in the pipe for controlling the mass flow of sterile air such that the pressure inside said tube of packaging material is controlled.

4. Method of controlling a pressure in a tube of packaging material in a filling machine for supplying liquid food to the tube of packaging material, a pipe for supplying pressurized sterile air to the tube of packaging material, and a gasket for sealing against the tube of packaging material and any pipes inside the tube, for creating an overpressure in said tube, said method comprising:

a) measuring a first pressure in the pipe, located upstream of the tube of packaging material, b) measuring the air mass flow in said pipe, c) calculating the pressure drop from the location of said upstream pressure to the tube, using the pressure and the mass flow, and d) calculating the pressure at said tube of packaging material as the pressure at the location of the first pressure minus the pressure drop from that location to the tube of packaging material, wherein measuring the air mass flow in said pipe comprises measuring a second pressure at a location upstream from the location of said first pressure, and providing a restriction between the location of the first pressure in the pipe and the location of the second pressure upstream from the location of said first pressure for obtaining measurements of the pressure difference between said first and second pressures.

5. Method according to claim 4, further comprising using said pressure drop from the location of the second pressure to the location of the first pressure for determining the air mass flow, according to a third pre-established relationship.

6. Method according to claim 4, further comprising:

controlling the air mass flow, by a control valve, for controlling the pressure inside the tube of packaging material.

* * * * *